US005231716A

United States Patent [19]

Johenning

[11] Patent Number: 5,231,716

[45] Date of Patent: Aug. 3, 1993

[54] WATERBED AND FRAME ASSEMBLY

[75] Inventor: John B. Johenning, Beverly Hills, Calif.

[73] Assignee: Strata Flotation, Inc., Torrance, Calif.

[21] Appl. No.: 848,060

[22] Filed: Feb. 21, 1992

[51] Int. Cl.[5] ..... A47C 27/08; A47C 19/00

[52] U.S. Cl. ..... 5/451; 5/400; 5/917; 5/907

[58] Field of Search ..... 5/451, 452, 450, 400, 5/917, 922, 907

[56] References Cited

U.S. PATENT DOCUMENTS

| | | | |
|---|---|---|---|
| 3,735,432 | 5/1973 | Kreten et al. | 5/451 |
| 3,838,470 | 10/1974 | May | 5/451 |
| 4,109,887 | 8/1978 | Wakeland, Jr. | 5/451 |
| 4,167,049 | 9/1979 | Fogel | 5/451 |
| 4,393,531 | 7/1983 | Hodel | 5/451 |
| 4,745,646 | 5/1988 | Strobel | 5/451 |
| 4,862,543 | 9/1989 | Falwell et al. | 5/663 |
| 5,027,453 | 7/1991 | Koenig | 5/451 |

*Primary Examiner*—Alexander Grosz
*Attorney, Agent, or Firm*—Flehr, Hohbach, Test, Albritton & Herbert

[57] ABSTRACT

Waterbed and frame assembly in which the frame rails are provided with cushioning pads and covered with a decorative fabric cover which is attached to the safety liner and to the lower portions of the rails to form an integrated liner, cover and rail structure. The cover is detachably connected to the liner and frame and is readily installed and removed for cleaning or to change the look of the bed. The tops of the pads on the side rails are substantially level with the top surface of the mattress, and the pads are thick enough to prevent discomfort to a person sitting on the edge of the bed from the relatively rigid rails. In one disclosed embodiment, the safety liner is attached to the outer sides of the rails, and in another it has self-standing side panels of a pliant material which yields with the pads when someone sits on the edge of the bed. The upper portions of the rails have an increased lateral dimension which provides a seating ledge and resists bowing due to pressure from the water in the mattress.

9 Claims, 3 Drawing Sheets

WATERBED AND FRAME ASSEMBLY

This invention pertains generally to waterbeds and, more particularly to a waterbed and frame assembly.

Waterbeds and waterbed frames heretofore provided have had a number of limitations and disadvantages. One of the more common types of frames is a quadrilateral structure with four boards or rails connected together at the corners. The rails are generally painted or stained, and beds with such frames have a distinctive appearance which some people may consider to be unattractive or not in keeping with the style of furniture they have, or want to have, in their bedrooms. Also, wooden rails are unyielding and uncomfortable sit upon.

The connectors which join the rails together can be difficult to install, and they may pose a problem from the standpoint of puncturing the mattress or bladder which holds the water. It can also be difficult to attach a headboard and/or a footboard to the frame of a waterbed.

Most waterbeds have a flexible safety liner positioned beneath and to the sides of the mattress, and there can be problems holding the liner in place while the bed is being set up and while the sheets are being changed or straightened. Sometimes the liner is stapled to the inside of the frame, but this poses an additional problem from the standpoint of puncturing the mattress. Some liners, known as "stand-up" liners, seek to avoid these problems by bonding the side panels of a flexible liner to relatively rigid stiffeners which are placed between the mattress and the frame.

Waterbeds with wood frames commonly have a plywood deck on which the water-filled mattress and the frame rails rest. The deck generally consists of several sections cut from sheets of plywood, placed side-by-side on a riser or pedestal. Since plywood commonly comes in sheets which are 48 inches wide, it is most economical to use either three 24 inch pieces or one 48 inch piece and one 24 inch piece for the deck of a king-size bed with a mattress which is 72 inches wide. However, this does not leave any material to go under the side rails, and these rails are frequently suspended from the head and foot rails without support from below.

Another problem with the frames heretofore provided is that they may require special tools or be too difficult for the average person to assemble.

It is in general an object of the invention to provide a new and improved waterbed and frame assembly.

Another object of the invention is to provide a waterbed and frame assembly of the above character which overcome the limitations and disadvantages of waterbeds and frame assemblies heretofore provided.

These and other objects are achieved in accordance with the invention by providing a waterbed and frame assembly in which the frame rails are provided with cushioning pads and covered with a decorative fabric cover which is attached to the safety liner and to the lower portions of the rails to form an integrated liner, cover and rail structure. The cover is detachably connected to the liner and frame and is readily installed and removed for cleaning or to change the look of the bed. The tops of the pads on the side rails are substantially level with the top surface of the mattress, and the pads are thick enough to prevent discomfort to a person sitting on the edge of the bed from the relatively rigid rails. In one disclosed embodiment, the safety liner is attached to the outer sides of the rails, and in another it has self-standing side panels of a pliant material which yields with the pads when someone sits on the edge of the bed. The upper portions of the rails have an increased lateral dimension which provides a seating ledge and resists bowing due to pressure from the water in the mattress.

The rails are connected together at the corners by fasteners which are installed from the outside, and pins hold the midpoints of the rails in position on the deck, which facilitates assembly of the frame and prevents bowing of the rails due to pressure of the water once the mattress is filled. The deck extends under the side rails as well as the end rails, and all four rails are thus fully supported. Mounting brackets are attached to one or more of the rails for attaching a headboard and/or a footboard to the bed.

Figure 1:
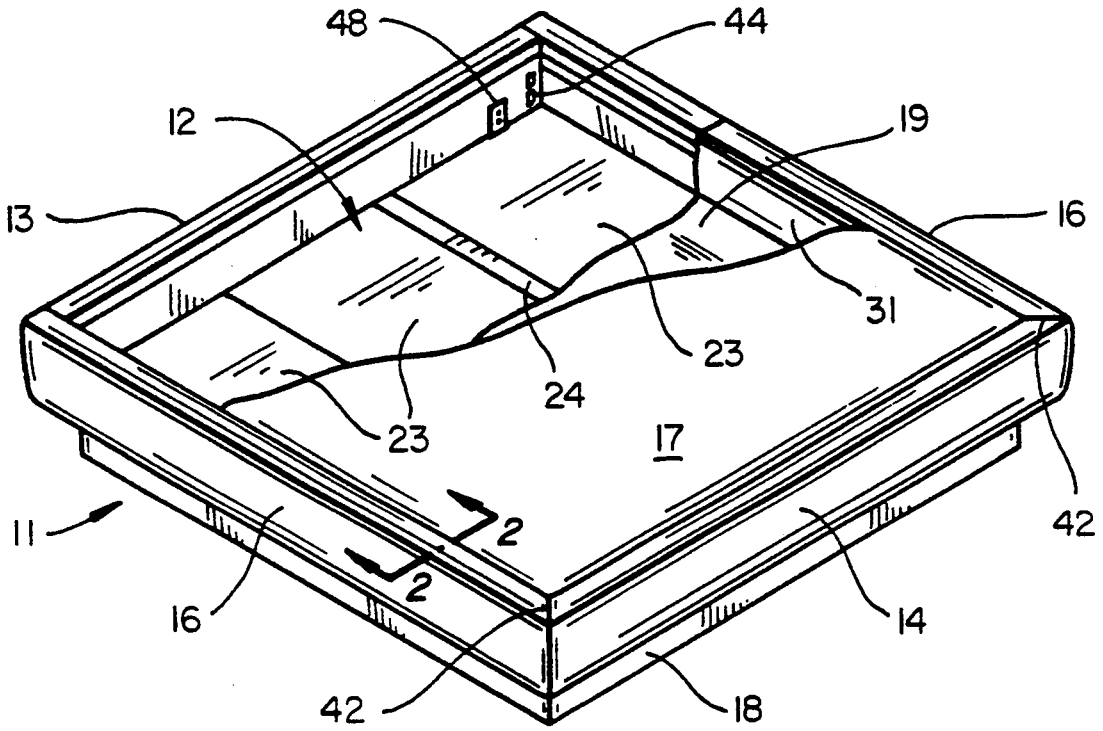
FIG. 1 is an isometric view, partly broken away of one embodiment of a waterbed according to the invention.
Figure 3:
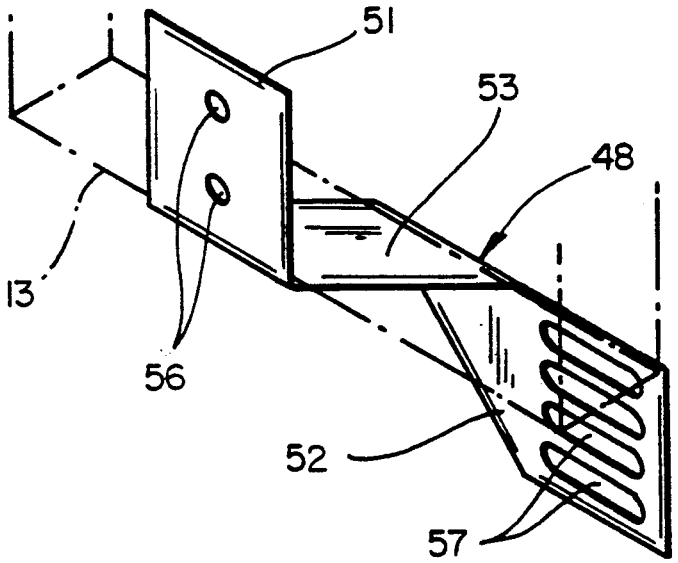
FIG. 3 is an isometric view of the headboard/footboard mounting bracket in the embodiment of FIG. 1.

As illustrated in FIG. 1, the waterbed has a generally rectangular frame 11 with a horizontally extending deck 12. The frame includes a head rail 13, a foot rail 14 and a pair of side rails 16. A water-filled bladder or mattress 17 rests on the deck, with the frame rails providing lateral support for the water in the mattress. The deck rests on a riser or base 18 which supports the deck and frame at a suitable height (e.g. 6–9 inches) above the floor or other supporting surface. A safety liner 19 extends beneath the mattress and along the inner sides of the rails to contain any water spillage from the mattress.

Each of the rails has a rigid core 21 fabricated of a material such as wood, composition board, or plastic, which rests on the deck, with the margin of the deck being received in a rabbet 22 along the lower edge of the rail. The core can be either solid or hollow as long as it has sufficient rigidity to support the water. In one presently preferred embodiment, the cores are cut from $2\times8$ or $2\times10$ inch lumber, and have a thickness on the order of $1\frac{1}{2}$ inches.

The bed illustrated is a king size bed, with a distance of approximately 72 inches between the inner faces of the side rails. In this embodiment, the deck consists of three 24-inch pieces of plywood 23, with a 2–3 inch filler strip 24 between two of the wider pieces. This gives the deck an overall width of about 74–75 inches, which enables it to extend under the side rails of the king size bed without wasting lumber in cutting the deck pieces.

The top portion of each of the side rails has an increased lateral dimension which provides a seating ledge and resists bowing due to pressure from the water. In the embodiment illustrated, the foot rail also has the increased lateral dimension, but the head rail does not. However, any combination of the wider and narrower rails is possible, although it is contemplated that in most applications both of the side rails will have the increased dimension.

Figure 2:
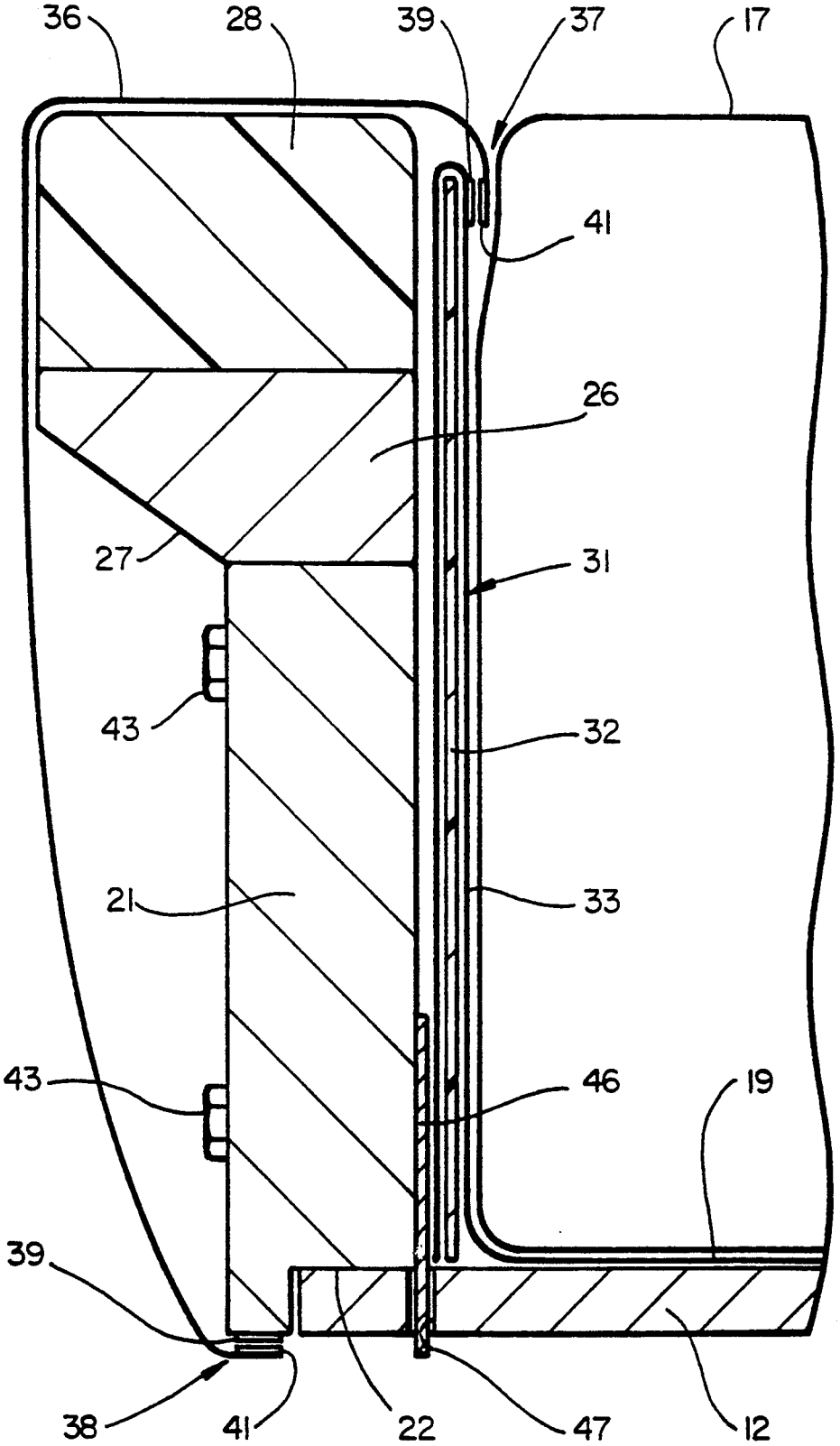
FIG. 2 is a cross-sectional view taken along line 2—2 in FIG. 1.

In the embodiment illustrated in FIG. 2, the increased lateral dimension is provided by an additional piece 26 of rigid material which extends along the upper margin of the core and projects laterally therefrom by a distance corresponding to the thickness of the core. In the example illustrated, the top piece extends along the upper surface of the core is affixed to the core by suitable means such as screws and glue (not shown). With a 1½ inch core, the top piece can, for example, have a thickness or height on the order of 1½ inch and a width on the order of 3 inches. The lower outer corner of the top piece is cut away or bevelled, as indicated at 27. Alternately, if desired, the top piece can be mounted on the outer side of the core, in which case it would be oriented with its narrower face horizontal and its wider face against the side of the core, with the narrower face level with the top surface of the core.

Each rail also includes a pad 28 of cushioning material, such as polyurethane foam, of sufficient thickness to prevent discomfort to a person sitting on the edge of the bed from the rigid core. The pad extends the full width of the top portion of the rail and can, for example, have a thickness on the order of 1½ to 2 inches. In the embodiment illustrated, the pad is cemented to the upper surface of top piece.

The dimensions of the elements which make up the rails are such that the tops of the pads are substantially level with the upper or sleeping surface of the mattress. Thus, for example, with a mattress having a depth on the order of 9 inches in the embodiment of FIG. 2, core 21 can have a height on the order of 5½ inches above the deck, top piece 26 can have a thickness on the order of 1½ inches, and pad 28 can have a thickness on the order of 2 inches. This provides a substantially more comfortable sitting surface than prior art frames with padded rail caps which extend above the surface of the mattress.

In the embodiment of FIG. 2, the liner has side panels 31 which stand by themselves next to the side and end rails and extend to a height just below the top of the rails. Each of the side panels has a core 32 of polyethylene foam or other suitable pliant material bonded to the flexible, water impervious material 33 of the liner. The flexible material extends across the top of the deck beneath the mattress, up the inner side of the foam core, across the top of the core and down the outer side of the core. While the pliant core is rigid enough to hold the side panel in an upright position between the mattress and the frame rail, it will also yield with the rail pad when someone sits on the edge of the bed so that the panel is not felt or damaged by the person sitting on the bed.

A decorative fabric cover 36 is removably mounted on the side and foot rails. The cover extends across the tops and outer sides of the rails and is attached to the liner and to the lower portions of the rails with hook and loop fasteners, e.g. Velcro fasteners, 37, 38 to form an integrated liner, cover and core structure. In the embodiment illustrated, strips 39 of the hook section of the fasteners are affixed along the upper inner margin of the side panels of the liner and along the lower edges of the rail cores, and strips 41 of the loop section are sewn along the upper and lower margins of the cover. At the corners between the side and foot rails, the cover is mitered and stitched along seam lines 42.

The cover can be made of any suitable upholstery material, woven or otherwise, with a decorative pattern or texture chosen to give the bed a desired look. If desired, the cover can be made reversible by providing fastener strips in back to back fashion on both sides of the cover. With different fabrics on the two sides of the cover, the appearance of the bed can be changed by simply reversing the cover. If the cover is fabricated of a material having a pile which interlocks with the fastener hooks on the liner and frame, it can be attached directly to those strips without the need for corresponding strips on the cover. This has an advantage of eliminating the need to align the strips on the cover to assure a desired tautness when the cover is installed, although this is not a critical problem since the strips have sufficient width to permit a substantial degree of adjustment. The cover fabric can be of any color, pattern or texture desire, and by making it of a material similar to the sheets used on the bed, the bed can be given an appearance somewhat similar to that of an innerspring mattress.

The head rail differs from the side and foot rails in that is not widened at the top. It has a foam pad similar in thickness to the other rail pads, which is mounted directly on top of the rigid core which is taller than the cores in the other rails. The pad on the head rail is covered by piece of fabric which is attached to the liner with a hook and loop fastener like the covers on the other rails, but is stapled to the outer side of the core a short distance below the pad. This fabric does not have to match the fabric on the other rails and can, for example, be a neutral color or one which matches that of the liner.

If the foot rail does not have the widened top, it can be made in a manner similar to that just described for the head rail, in which case the cover on each side rail will be separate.

Since the outer portions of the rails are covered, the rails can be connected together at the corners with fasteners which are installed and removed from outside the frame, which greatly simplifies the process of setting up the bed. It also eliminates the need for internal connectors which can be difficult to install and can also puncture the mattress. In the embodiment illustrated, the rails are connected together by bolts 43 which pass through the side rails and are received in nuts 44 in the end rails.

Pins 46 hold the midpoints of the rails in position on the deck and help to prevent the rails from being bowed in an outward direction by the pressure of the water in the mattress. In the embodiment illustrated, these pins are in the form of rectangular metal plates having a length on the order of 3 inches and a width on the order of 1 inch, and they are affixed to the inner faces the rails by screws (not shown), with a portion of each plate projecting past the rabbet. The projecting portion of the plate is received in a socket comprising a slotted opening 47 in the deck. The slotted opening has dimensions somewhat greater than the width and thickness of the plate, so that the pins are easily engaged with and disengaged from the sockets, yet hold the rails against lateral deflection when engaged. The pins also facilitate assembly of the bed since they are easy to engage and serve to hold the rails in the correct positions while the bolts are installed to join the rails together.

Means is also provided for attaching a headboard to the frame. This means includes a pair of mounting brackets 48 which are mounted on head rail 13. Each of these brackets has a first flange 51 which is affixed to the inner side of the rail, a second flange 52 positioned outside the frame, and a central section 53 which interconnects the two flanges and passes beneath the rail. The central section extends at an angle of 45 degrees between the two flanges, and the two flanges extend in opposite directions, with flange 51 extending in an upward direction from the central section and flange 52 extending down. The two flanges lie in parallel planes, with flange 52 being offset below and to the outside of flange 51 for registration with the mounting brackets on a conventional headboard, and central section 53 passing beneath the head rail at an oblique angle of about 45 degrees relative to the rail. Flange 51 has holes 56 for mounting screws, and flange 52 has slots 57 for receiving mounting lugs on the mounting bracket of the headboard.

A footboard can be attached to the bed in the same manner as the headboard, with mounting brackets similar to brackets 48 being mounted on the foot rail.

Assembly and use of the waterbed and frame assembly are as follows. The riser is placed on the floor or other supporting surface where the bed is to be set up, and the deck boards are laid out in position on the riser. The rails are then positioned along the edges of the deck, with the pins on the rails being received in the sockets in the deck. The bolts are then installed to connect the rails together. The liner is placed in the cavity formed by the deck and rails, with the side panels of the liner standing upright next to the rails. The mattress is spread out on top of the liner and filled with water. The decorative fabric cover can be installed either before or after the mattress is filled, and it can be removed and replaced at any time after for cleaning, replacement, or to change the look of the bed. If a heater is used, it is placed on the deck before the liner is installed, and if a headboard and/or a footboard is to be attached, the mounting brackets are best installed before the mattress is filled, although with proper care, they can still be installed, or removed, when the mattress is full.

Figure 4:
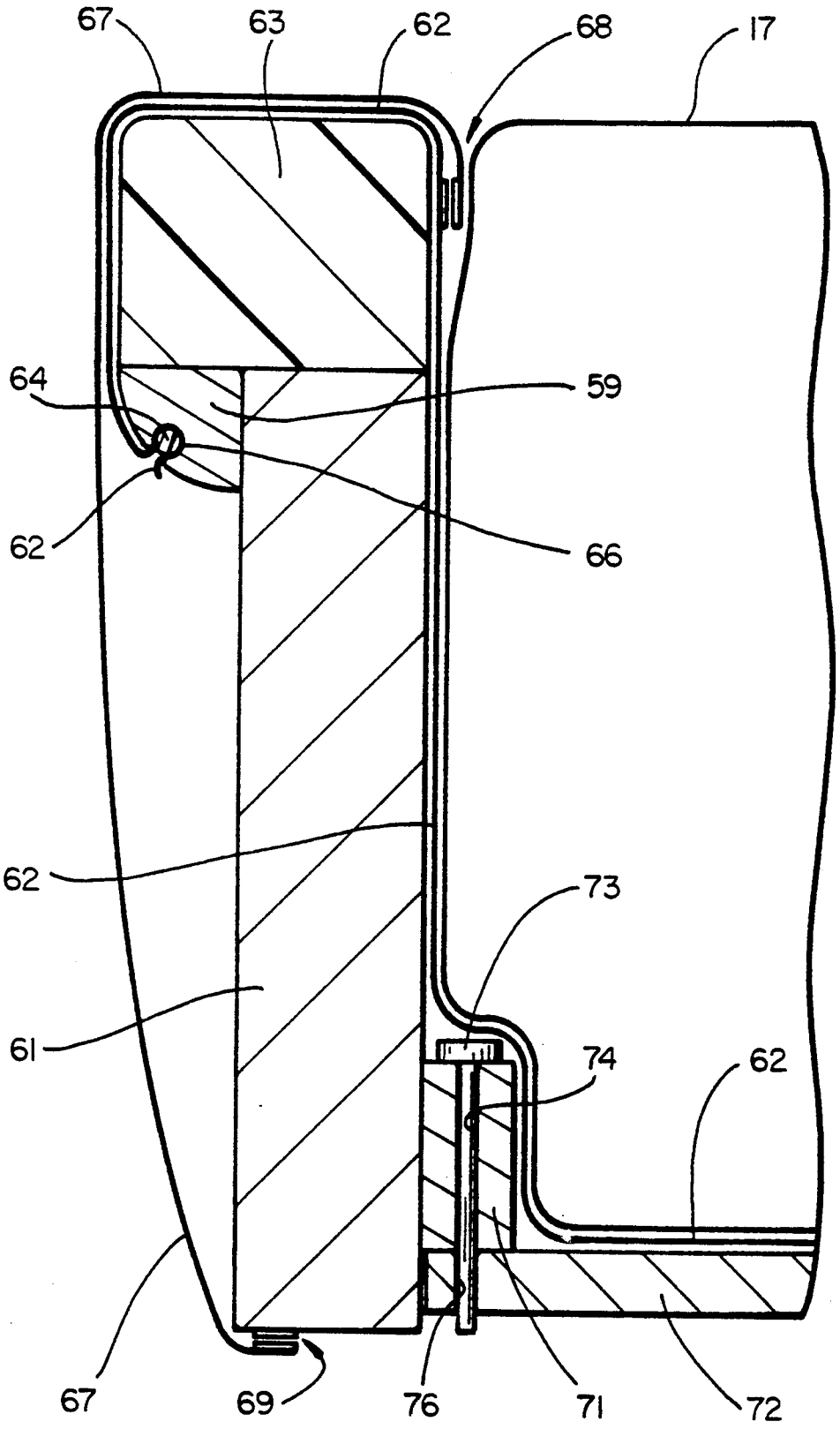
FIG. 4 is a cross-sectional view similar to FIG. 2 of another embodiment of a frame assembly according to the invention.

The embodiment of FIG. 4 is generally similar to that of FIG. 2. However, the top piece 59 is attached to the side of the rail core 61 and has a rounded outer and under side. In this embodiment, the safety liner 62 extends across the top of the rail pad 63 and is attached to the outer portion of the rail by a keeper rod 64 in a groove 66 on the underside of top piece 59. A decorative fabric cover 67 is attached to the liner along the upper inner margin of the rail and to the lower edge of the rail core by hook and loop fasteners 68, 69 in the manner discussed above.

A cleat 71 extends along the inner side of core 61 and rests on the outer margin of deck 72, rather than having the deck extend under the core itself. This eliminates the need for a filler strip to extend the width of the deck beyond 72 inches when three 24 inch pieces are used. Locator pins 73 pass through aligned openings 74, 76 in the cleat and deck to hold the midpoint of the rail in place on the deck.

Assembly and use of the embodiment of FIG. 4 are similar to that described above in connection with the previous embodiment, except the liner is now attached to the rails instead of standing on its own.

The frame assembly of the invention can also accommodate the type of headboard which has previously been used with waterbeds. Such headboards are typically about 10–12 inches deep and may have book shelves in them. To accommodate such a headboard, the side rails of the frame are extended about 10–12 inches beyond the head rail, and the headboard rests on them. If desired, the sides of the headboard can be covered with fabric or upholstered to coordinate with or match the covers on the frame.

It is apparent from the foregoing that a new and improved waterbed and frame assembly have been provided. While only certain presently preferred embodiments have been described in detail, as will be apparent to those familiar with the art, certain changes and modifications can be made without departing from the scope of the invention as defined by the following claims.

I claim:

1. In a frame assembly for a bed with a water-filled mattress: a horizontally extending generally rectangular rigid deck, head and foot rail members extending along opposite ends of the deck, side rail members extending along opposite sides of the deck between the head and foot rail members, means rigidly connecting the rail members together and to the deck to form a rigid circumscribing frame for providing lateral support for water in a mattress resting on the deck, a safety liner extending across the upper surface of the deck and along the inner sides of the rail members for containing water spillage from the mattress, a decorative fabric cover extending along the top and outer sides of the foot and side rail members, and means affixing the cover to the liner and to the lower portions of the foot and side rail members to form an integrated liner and cover structure.

2. The frame assembly of claim 1 wherein the means affixing the cover to the liner and to the lower portions of the rail members comprises hook and pile fasteners.

3. The frame assembly of claim 1 wherein the liner has side panels which can stand by themselves in an upright position beside the rail members, and the fabric cover is affixed to the self-standing side panels of the liner.

4. The frame assembly of claim 1 wherein the liner extends over the top sides of the rail members beneath the cover and is secured to the outer portions of the rail members.

5. In a waterbed: a water-filled mattress, a rigid rail providing lateral support for the water in the mattress, a pad of cushioning material mounted on the rail and having a height on the order of at least 15 percent of the height of the rail, the rail and the pad together having a combined height substantially equal to the depth of the mattress so that the upper portion of the pad is substantially level with the upper surface of the mattress, a safety liner extending along the inner sides of the pad and the rail and beneath the mattress for containing water spillage from the mattress and having a side panel with a pliant foam core which can stand by itself in an upright position adjacent to the rail without being attached to the rail, said side panel extending to the top of the pad and yielding with the pad when a person sits on the edge of the bed, and a decorative fabric cover extending over the top of the pad and along the outer sides of the pad and the rail.

6. The waterbed of claim 5 including means affixing the cover to the liner and to the lower portion of the rail to form an integrated liner and cover structure.

7. The waterbed of claim 6 wherein the liner extends over the top and outer sides of the pad and is secured to the rail away from the mattress.

8. The waterbed of claim 5 wherein the top portion o the rail has an increased lateral dimension which provides a seating ledge and resists bowing due to pressure from the water.

9. The waterbed of claim 8 wherein the rail comprises a wooden core having a thickness on the order of 1½ inches and a top piece which extends along the upper margin of the core and projects laterally from the core by a distance on the order of 1~ inches.

* * * * *